US011523722B2

(12) United States Patent
Wang

(10) Patent No.: US 11,523,722 B2
(45) Date of Patent: Dec. 13, 2022

(54) DIRTINESS LEVEL DETERMINING METHOD AND ELECTRONIC DEVICE APPLYING THE DIRTINESS LEVEL DETERMINING METHOD

(71) Applicant: PixArt Imaging Inc., Hsin-Chu (TW)

(72) Inventor: Guo-Zhen Wang, Hsin-Chu (TW)

(73) Assignee: PixArt Imaging Inc., Hsin-Chu (TW)

( * ) Notice: Subject to any disclaimer, the term of this patent is extended or adjusted under 35 U.S.C. 154(b) by 713 days.

(21) Appl. No.: 16/423,165

(22) Filed: May 28, 2019

(65) Prior Publication Data

US 2020/0375426 A1 Dec. 3, 2020

(51) Int. Cl.
*A47L 9/28* (2006.01)
*A47L 9/30* (2006.01)

(52) U.S. Cl.
CPC ..... *A47L 9/2815* (2013.01); *A47L 9/30* (2013.01); *A47L 2201/022* (2013.01); *A47L 2201/04* (2013.01); *A47L 2201/06* (2013.01)

(58) Field of Classification Search
CPC ..... A47L 2201/022; A47L 2201/04; A47L 2201/06; A47L 9/2815; A47L 9/2826; A47L 9/30
See application file for complete search history.

(56) References Cited

U.S. PATENT DOCUMENTS 7,161,136 B1 1/2007 Wenstrand
9,862,098 B2 * 1/2018 Zhang ..... B25J 9/1697
10,551,843 B2 * 2/2020 Yee ..... G05D 1/0274
2004/0227954 A1 11/2004 Xie
2005/0192707 A1 * 9/2005 Park ..... G05D 1/0272 700/259
2005/0206617 A1 9/2005 Moyer
2006/0044267 A1 3/2006 Xie
2006/0047364 A1 * 3/2006 Tani ..... A47L 9/009 701/23
2006/0192761 A1 8/2006 Cheah
2008/0151233 A1 * 6/2008 Blanke ..... G01N 21/47 901/47
2012/0079670 A1 * 4/2012 Yoon ..... G05D 1/0274 15/49.1
2012/0247510 A1 * 10/2012 Chen ..... G05D 1/0219 134/18

(Continued)

FOREIGN PATENT DOCUMENTS

CN 101711353 A 5/2010
CN 102121900 A 7/2011

(Continued)

*Primary Examiner* — Marc Carlson
(74) *Attorney, Agent, or Firm* — Winston Hsu

(57) ABSTRACT

A dirtiness level determining method applied to an electronic device comprising an image sensor. The method comprises: (a) capturing a first image at a first time point according to first type of light; (b) capturing a second image at a second time point after the first time point according to the first type of light; (c) calculating a first fixed pattern according to a first difference between the first image and the second image; and (d) calculating a first dirtiness level of the image sensor according to the first fixed pattern; (e) generating a first notifying message if the first dirtiness level is higher than a dirtiness threshold.

18 Claims, 4 Drawing Sheets

(56) References Cited

U.S. PATENT DOCUMENTS

| | | | | |
|---|---|---|---|---|
| 2014/0115797 | A1* | 5/2014 | Duenne | A47L 9/009 15/3 |
| 2014/0124004 | A1* | 5/2014 | Rosenstein | G05D 1/0219 15/3 |
| 2015/0327742 | A1* | 11/2015 | Strang | G01N 21/255 15/49.1 |
| 2018/0113517 | A1* | 4/2018 | Yang | G06F 3/0317 |
| 2018/0289225 | A1* | 10/2018 | Izawa | G01B 11/026 |
| 2018/0348373 | A1* | 12/2018 | Chen | G01S 17/50 |
| 2019/0128821 | A1* | 5/2019 | Yang | G06F 3/0383 |
| 2019/0239709 | A1* | 8/2019 | Thomas | B25J 9/1694 |
| 2020/0107689 | A1* | 4/2020 | Yang | A47L 11/4011 |
| 2021/0247327 | A1 | 8/2021 | Wang | |

FOREIGN PATENT DOCUMENTS

| | | | |
|---|---|---|---|
| CN | 103443612 | A | 12/2013 |
| CN | 106706644 | A | 5/2017 |
| CN | 107917918 | A | 4/2018 |
| CN | 108663371 | A | 10/2018 |
| CN | 110865637 | A | 3/2020 |
| EP | 3 367 660 | A1 | 8/2018 |
| KR | 10-2011-0124506 | A | 11/2011 |
| TW | 200701037 | | 1/2007 |
| TW | 201314505 | A1 | 4/2013 |

* cited by examiner

DIRTINESS LEVEL DETERMINING METHOD AND ELECTRONIC DEVICE APPLYING THE DIRTINESS LEVEL DETERMINING METHOD

BACKGROUND OF THE INVENTION

1. Field of the Invention

The present invention relates to a dirtiness level determining method and an electronic device applying the dirtiness level determining method, and particularly relates to a dirtiness level determining method and an electronic device applying the dirtiness level determining method, which can determine a dirtiness level of an image sensor according to images.

2. Description of the Prior Art

As the technique advances, the auto clean machine (e.g. a robot cleaner) becomes more and more popular. An auto clean machine always has an image sensor to capture images, based on which the auto clean machine can track a location thereof. However, the image sensor may become dirty if the auto clean machine has worked for a period of time. Such situation may affect the tracking function of auto clean machine.

A conventional auto clean machine does not have a proper solution for such problem, thus a user must clean the image sensor frequently, or knows that the image sensor needs to be cleaned when the automatic cleaning machine does not operate smoothly.

SUMMARY OF THE INVENTION

Therefore, one objective of the present invention is to provide a dirtiness level determining method which can automatically detect a dirtiness level of an image sensor.

Another objective of the present invention is to provide an electronic device which can automatically detect a dirtiness level of an image sensor provided therein.

One objective of the present invention provides a dirtiness level determining method applied to an electronic device comprising an image sensor. The method comprises: (a) capturing a first image at a first time point according to first type of light; (b) capturing a second image at a second time point after the first time point according to the first type of light; (c) calculating a first fixed pattern according to a first difference between the first image and the second image; and (d) calculating a first dirtiness level of the image sensor according to the first fixed pattern; (e) generating a first notifying message if the first dirtiness level is higher than a dirtiness threshold.

Another embodiment of the present invention provides a dirtiness level determining method applied to an electronic device comprising an image sensor. The method comprises: capturing an image of a reference surface as a reference image: capturing a current image; calculating a fixed pattern according to a difference between the reference image and the current image; and calculating a dirtiness level of the image sensor according to the fixed pattern; and generating a notifying message if the dirtiness level is higher than a dirtiness threshold.

Still another embodiment of the present invention discloses an electronic device comprising: a first type of light source, configured to emit first type of light; a second type of light source, configured to emit second type of light; an image sensor, configured to capture a plurality of first images according to the first type of light or to capture a plurality of second images according to the second type of light; and a control circuit, coupled to the image sensor, configured to perform: (a) calculating a first result according to the first images; (b) calculating a second result according to the second images; and (c) using the first result or the second result according to a confidence level.

Still another embodiment of the present invention discloses an electronic device comprising: a first type of light source, configured to emit first type of light; an image sensor, configured to capture a plurality of images according to the first type of light; and a control circuit, coupled to the image sensor, configured to perform: (a) calculating a number of the fixed patterns according to the images; (b) generating a notifying message if the number of the fixed patterns is higher than a dirtiness threshold.

The present invention further provides an electronic device can perform the above-mentioned methods. The electronic device comprises a control circuit and an image sensor, and can be an auto clean machine.

In view of above-mentioned embodiments, the dirtiness level of the image sensor can be automatically determined by the auto clean machine, thus the user can be notified before the auto clean machine cannot normally operate.

These and other objectives of the present invention will no doubt become obvious to those of ordinary skill in the art after reading the following detailed description of the preferred embodiment that is illustrated in the various figures and drawings.

DETAILED DESCRIPTION

Several embodiments are provided to explain the concept of the present invention. Please note, each component in the embodiments can be implemented by hardware (e.g. device or circuit) or firmware (e.g. processor installed with at least one program). Further, the term "first", "second" . . . are only for defining different steps or components, but do not mean any sequence thereof. Further, in following descriptions, the description "the image sensor is dirty" can mean the image sensor is really dirty, or means a cover or a film covering the image sensor is dirty thus affect the capturing operation of the image sensor.

Figure 1:
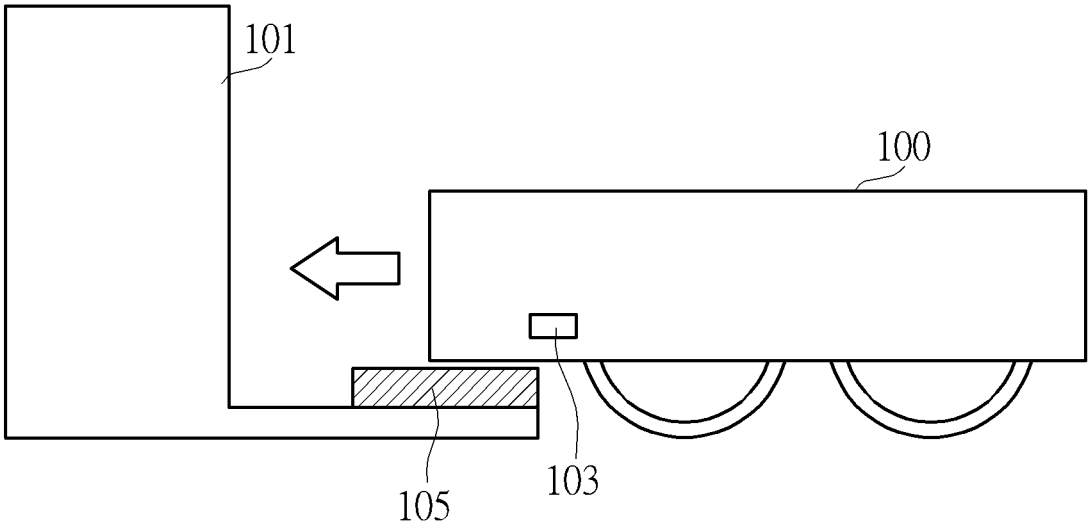
FIG. 1 is a schematic diagram illustrating an auto clean machine according to one embodiment of the present invention.

FIG. 1 is a schematic diagram illustrating an auto clean machine according to one embodiment of the present invention. As illustrated in FIG. 1, an auto clean system always comprises an auto clean machine 100 and a charging station 101. After performing a clean operation, the auto clean machine 100 can automatically go back to the charging station and be charged, or a user can control the auto clean machine 100 to go back to the charging station for charging.

In one embodiment, the charging station 101 comprises a reference surface 105 and the auto clean machine 100 comprises an image sensor 103. After going back to the charging station 101, the image sensor 103 captures an image of the reference surface 105 as a current image. An image of the reference surface 105 when the image sensor 103 is clean is pre-recorded in the auto clean machine 100 as a reference image. The auto clean machine 100 compares the current image and the reference image to determine a fixed pattern of images captured by the image sensor 103. The reference surface 105 can be provided on a board independent from the charging station 101, and can be provided on any part of the charging station 101. Please note, in the embodiment of FIG. 1, the image sensor 103 captures an image below it (i.e. the capturing direction of the image sensor 103 is down), thus the reference surface is provided below the image sensor 103. However, the reference surface 105 can be provided at any location corresponding to the capturing direction of the image sensor 103.

A size and an obvious degree of the fix pattern can indicate the dirtiness level of the image sensor 103. The bigger the size is, or the higher the obvious degree is, can indicate the dirtiness level is higher. If the auto clean machine 100 determines the dirtiness level of the image sensor 103 is larger than a dirtiness threshold according to the fixed pattern, the auto clean machine 100 can generate a notifying message to notify a user the image sensor 103 is dirty. The notifying message can be, for example, a light message, a video message, an audio message, or a combination thereof. In one embodiment, a number of the fixed pattern, which can indicate the dirtiness level, is calculated and the auto clean machine 100 determines whether the number is larger than the dirtiness threshold or not. The auto clean machine 100 generates a notifying message to notify a user the image sensor 103 is dirty if the number is larger than the dirtiness threshold.

Figure 2:
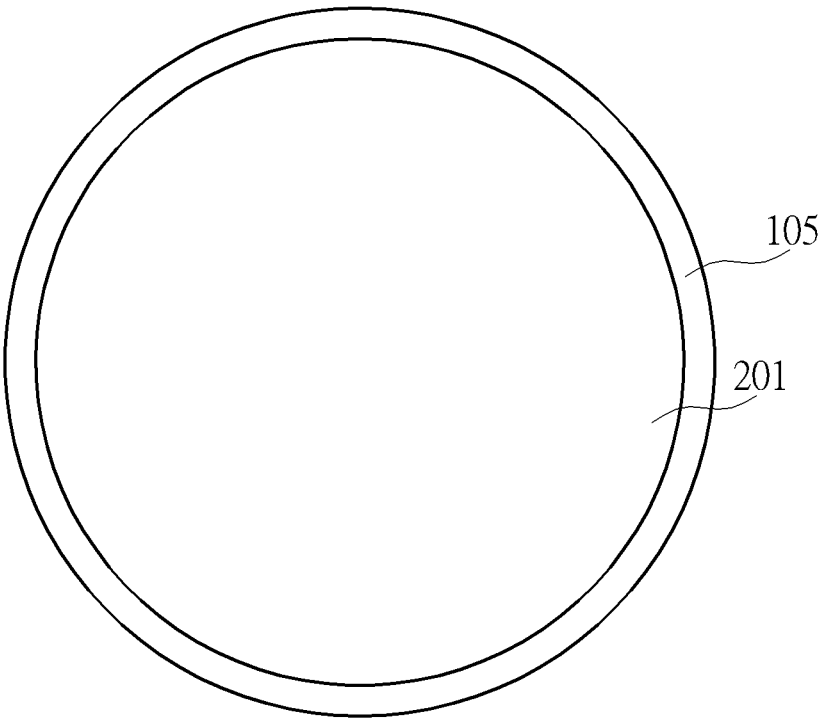
FIG. 2 is a schematic diagram illustrating the reference surface shown in FIG. 1, according to one embodiment of the present invention.

FIG. 2 is a schematic diagram illustrating the reference surface 105 shown in FIG. 1, according to one embodiment of the present invention. As illustrated in FIG. 2, the reference surface 105 comprises a blank area 201. Accordingly, the reference image is a blank image. If the image sensor 103 is clean, the image of the blank area 201 captured by the image sensor 103 is also a blank image. However, if the image sensor 103 is dirty, a fixed pattern caused by the dirt on the image sensor 103 exists in the image of the blank area 201. Please note, the reference surface 105 is not limited to comprise the blank area 201. Any type of the reference surface 105 can reach the same function should also fall in the scope of the present invention. In one embodiment, the reference surface 105 comprises a reference area with a specific color or a specific pattern to replace with the blank area 201.

Further, in another embodiment, the reference surface 105 is provided on a movable part of the charging station 101. In such case, the reference surface 105 can move into the charging station 101 when it is not used and move out from the charging station 101 for capturing the reference image or the current image.

Figure 3:
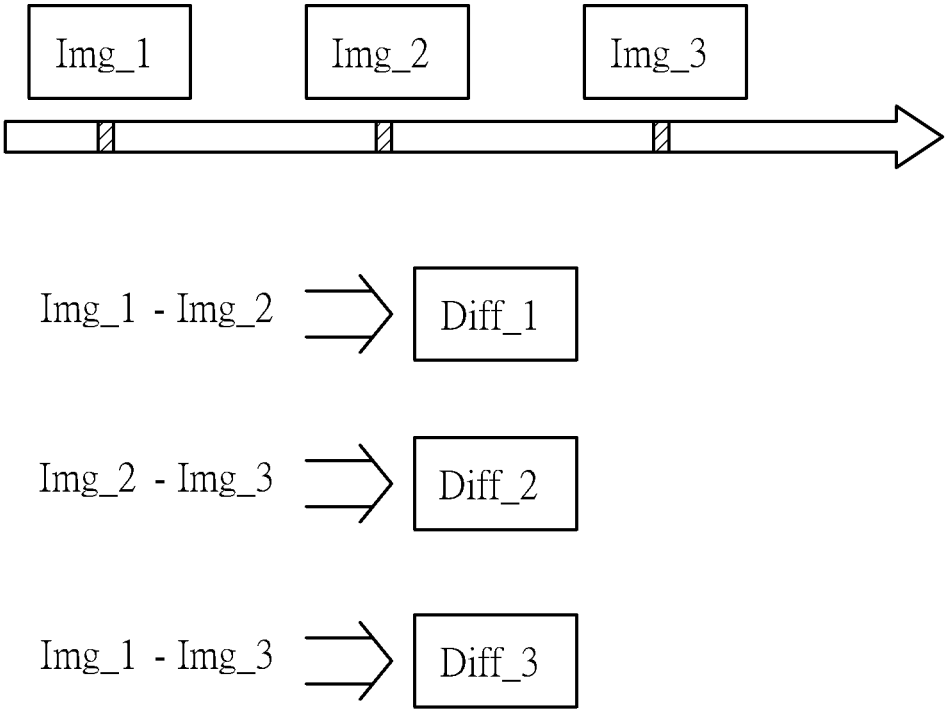
FIG. 3 is a schematic diagram illustrating the steps of a dirtiness level determining method according to one embodiment of the present invention.

Besides using the reference surface 105, the present invention further provides a method of determining the dirtiness according to images at different time points. FIG. 3 is a schematic diagram illustrating the steps of a dirtiness level determining method according to one embodiment of the present invention. As illustrated in FIG. 3, the image sensor 103 respectively captures a first image Img_1, a second image Img_2, and a third image Img_3 at the time points T_1, T_2 and T_3. After that, a first difference Diff_1 between the first image Img_1 and the second image Img_2 is calculated, a second difference Diff_2 between the second image Img_2 and the third image Img_3 is calculated, and a third difference Diff_3 between the first image Img_1 and the third image Img_3 is calculated. The first difference Diff_1, the second difference Diff_2 and the third difference Diff_3 can mean difference images or difference pixel values of the difference images.

The fixed pattern can be acquired by the first difference Diff_1, the second difference Diff_2 and the third difference Diff_3. For example, the fixed pattern can be acquired according to the identical pixels or pixels having similar pixel values of the first image Img_1, the second image Img_2 and the third image Img_3. However, such fixed pattern may be affected by other identical pixels or pixels having similar pixel values. Accordingly, in one embodiment, an intersection of the first difference Diff_1, the second difference Diff_2 and the third difference Diff_3 is calculated to acquire the fixed pattern.

In one embodiment, a parameter Index is calculated by the following function:

$$\text{Index}=(\text{Diff_1}\cap\text{Diff_2}\cap\text{Diff_3})$$

The Index is a parameter which can indicate the fixed pattern. The higher the Index is, the more obvious the fixed pattern is, or the larger the fixed pattern is. In one embodiment, the Index is an average pixel value of an intersection image of the first image Img_1, the second image Img_2 and the third image Img_3. However, the Index can be any other image information which can indicate the fixed pattern, such as a maximum pixel value, a feature level.

However, the fixed pattern is not limited to be calculated according to three different images or more than three different images. For example, the embodiment in FIG. 3 can calculate the fixed pattern only according to two images such as the first difference Diff_1 and the second difference Diff_2, but not according to the third difference Diff_3. For another example, the embodiment in FIG. 3 can calculate the fixed pattern only according to other two images such as the second difference Diff_2 and the third difference Diff_3 but not according to the first difference Diff_1.

During a clean operation, the auto clean machine 100 may move on different types of surfaces, and each type of surface may be suitable for different types of light. For example, light generated by a LED (light emitting diode) may be suitable for a wood surface, and light generated by a LD (laser diode) may be suitable for a white tile surface. Therefore, in one embodiment, the auto clean machine 100 comprises more than one type of light source. The light source being used can be selectively switched to another light source.

Figure 4:
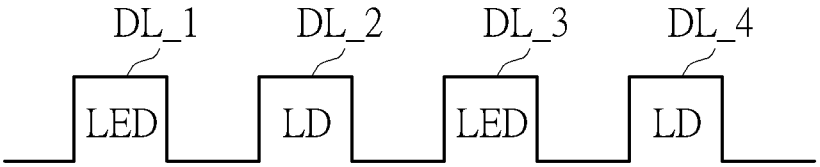
FIG. 4 and FIG. 5 are schematic diagrams illustrating using different types of light sources, according to different embodiments of the present invention.

In following embodiments, a LED and a LD are taken as examples to explain the concept of the present invention. However, the light source can be any type of light source besides the LED and the LD. In one embodiment, different types of light sources are alternatively switched. As illustrated in FIG. 4, a first dirtiness level DL_1 is calculated according to the LED light (i.e. a first type of light) following above-mentioned steps and then a second dirtiness level DL_2 is calculated according to the LD light (i.e. a second type of light) following above-mentioned steps. The third dirtiness level DL_3 and the fourth dirtiness level DL_4 are calculated following the same rules.

In one embodiment, one of the LED light and the LD light is selected as light applied by the auto clean machine 100 according to which one of the LED light and the LD light is more reliable. Various methods can be applied to determine which one of the LED light and the LD light is more reliable. For example, the LED light and the LD light can be tested to determine which one can respond the dirtiness level for a specific light source power or a specific mechanic structure of the auto clean machine 100. Such test result can be recorded in the auto clean machine 100, and the light source is accordingly selected.

In one embodiment, the image sensor 103 alternatively captures a plurality of first images according to the LED light and capture a plurality of second images according to the LD light. After that, the auto clean machine 100 calculates a first result according to the first images and calculates a second result according to the second images. Also, the auto clean machine 100 uses the first result or the second result for following processes according to a confidence level. That is, the auto clean machine 100 uses the first result or the second result according to which one of the LED light and the LD light is more reliable.

Figure 5:
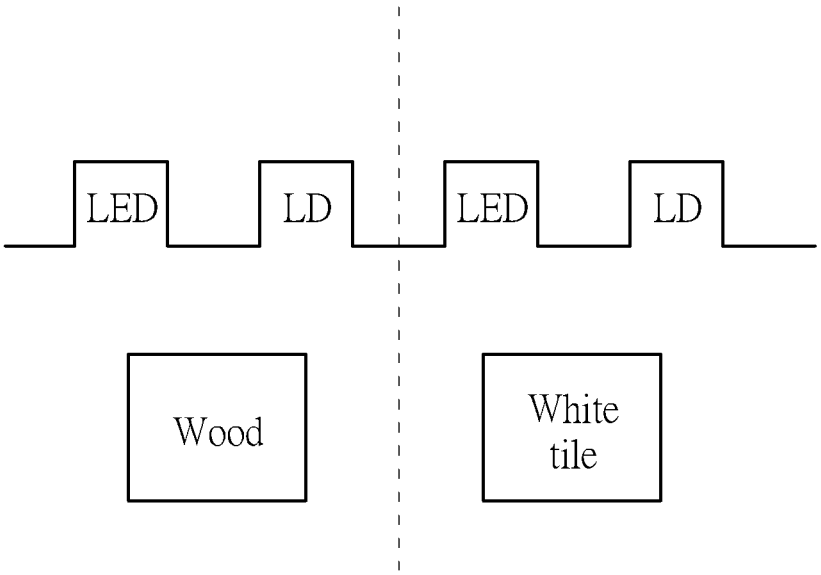

For another example, the LED light and the LD light can be tested to determine which one is suitable for a specific type of surface. Such test result can be recorded in the auto clean machine 100, and the light source is accordingly selected. As shown in FIG. 5, it is supposed the LED light is more suitable for a wood surface and the LD light is more suitable for a white tile surface. Therefore, if the auto clean machine 100 determines the surface which the auto clean machine 100 is provided on is a wood surface, the LED is applied. Also, if the auto clean machine 100 determines the surface which the auto clean machine 100 is changed to a white tile surface, the LD light is applied.

Therefore, for the embodiment illustrated in FIG. 5, a surface type of a surface which the auto clean machine 100 is provided on is first determined, and then one of the LD light and the LED light is selected based on the surface type. Many methods can be applied to determine the surface type, for example, the auto clean machine 100 can comprise a material analyzing device which can determine the surface type, but not limited.

Figure 6:
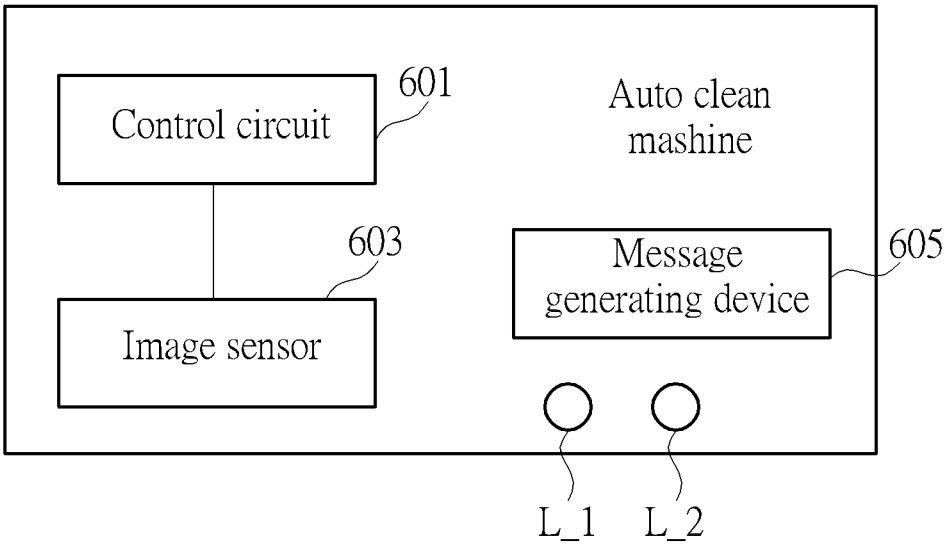
FIG. 6 is a block diagram illustrating an auto clean machine according to one embodiment of the present invention.
Figure 7:
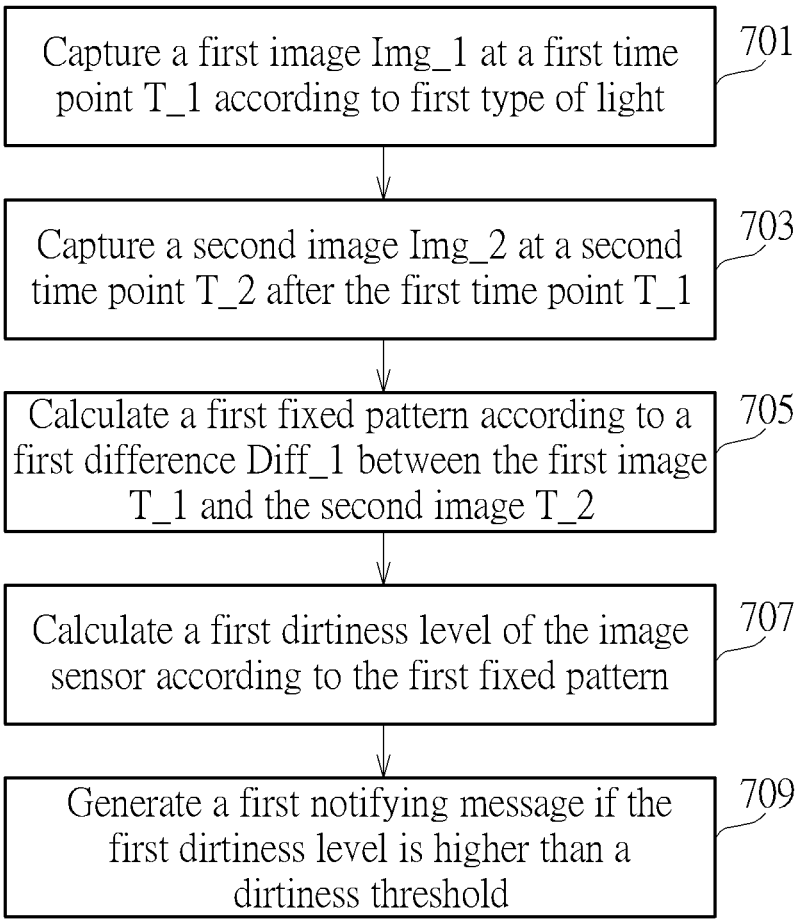
FIG. 7 is a flow chart illustrating a dirtiness level determining method according to one embodiment of the present invention.

FIG. 6 is a block diagram illustrating an auto clean machine according to one embodiment of the present invention. As illustrated in FIG. 6, the auto clean machine 600 comprises a control circuit 601, an image sensor 603, and at least one light source (in this example, two different types of light sources L 1, L 2). The image sensor 603 is configured to capture images. Also, the control circuit 601 is configured to calculate required data based on the images, such as the difference between different images or the fixed pattern illustrated in FIG. 3. The control circuit 601 can also control other operations of the auto clean machine 600. The message generating device 605 is configured to generate the above-mentioned notifying message. Besides, if the auto clean machine 600 needs to store data such as the reference image or the test result, the auto clean machine 600 can further comprise a storage device such as a memory device.

It will be appreciated that the above-mentioned embodiments can be applied to any electronic device comprising an image sensor, rather than limited to an auto clean machine. Therefore, a dirtiness level determining method can be acquired according to above-mentioned embodiments, which can be applied to an electronic device comprising an image sensor and comprises:

Step 701

Capture a first image Img_1 at a first time point T_1 according to first type of light.

Step 703

Capture a second image Img_2 at a second time point T_2 after the first time point T_1.

Step 705

Calculate a first fixed pattern according to a first difference Diff_1 between the first image T_1 and the second image T_2.

Step 707

Calculate a first dirtiness level of the image sensor according to the first fixed pattern.

Step 709

Generate a first notifying message if the first dirtiness level is higher than a dirtiness threshold.

In view of above-mentioned embodiments, the dirtiness level of the image sensor can be automatically determined by the auto clean machine, thus the user can be notified before the auto clean machine cannot normally operate.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dirtiness level determining method, applied to a robot cleaner comprising an image sensor, comprising:

(a) capturing a first image at a first time point according to first type of light;

(b) capturing a second image at a second time point after the first time point according to the first type of light;

(c) calculating a first fixed pattern according to a first difference between the first image and the second image;

(d) calculating a first dirtiness level of the image sensor according to the first fixed pattern;

(e) generating a first notifying message if the first dirtiness level is higher than a dirtiness threshold;

wherein the dirtiness level determining method further comprises:

capturing a third image at a third time point after the second time point;

calculating a second difference between the second image and third image;

calculating the first fixed pattern according to an intersection of the first difference and the second difference.

2. The dirtiness level determining method of claim 1, further comprising:

calculating a third difference between the first image and third image;

calculating the first fixed pattern according to an intersection of the first difference, the second difference and the third difference.

3. The dirtiness level determining method of claim 1, further comprising:

applying a second type of light to calculate a second dirtiness level of the image sensor based on the step (a) and the step (b) after calculating the first dirtiness level.

4. The dirtiness level determining method of claim 1, further comprising:

selecting one of the first type of light and second type of light as light applied by the robot cleaner according to which one of the first dirtiness level and the second first dirtiness level is more reliable.

5. The dirtiness level determining method of claim 1, further comprising:

determining a surface type of a surface which the robot cleaner is provided on; and selecting one of the first type of light and a second type of light to perform the step (a) and the step (b) according to the surface type.

6. A robot cleaner, comprising:

a first type of light source, configured to emit first type of light;

an image sensor, configured to capture a first image at a first time point, and to capture a second image at a second time point after the first time point, according to the first type of light; and a control circuit, coupled to the image sensor, configured to perform:

(a) calculating a first fixed pattern according to a first difference between the first image and the second image;

(b) calculating a first dirtiness level of the image sensor according to the first fixed pattern; and (c) generating a notifying message if the first dirtiness level is higher than a dirtiness threshold;

wherein the image sensor further captures a third image at a third time point after the second time point, wherein the control circuit calculates a second difference between the second image and third image, and calculates the first fixed pattern according to an intersection of the first difference and the second difference.

7. The robot cleaner of claim 6, wherein the control circuit further calculates a third difference between the first image and third image, and calculates the first fixed pattern according to an intersection of the first difference, the second difference and the third difference.

8. The robot cleaner of claim 6, further comprising:

a second type of light source, configured to generate second type of light;

wherein the control circuit further calculates a second dirtiness level of the image sensor based on the step (a) and the step (b) according to the second type of light, after calculating the first dirtiness level.

9. The robot cleaner of claim 6, further comprising:

a second type of light source, configured to generate second type of light;

wherein the control circuit further selects one of the first type of light and the second type of light as light applied by the robot cleaner according to which one of the first dirtiness level and the second first dirtiness level is more reliable.

10. The robot cleaner of claim 6, further comprising:

a second type of light source, configured to generate second type of light;

wherein the control circuit determines a surface type of a surface which the robot cleaner is provided on, and selects one of the first type of light and the second type of light to perform the step (a) and the step (b) according to the surface type.

11. An robot cleaner comprising:

a first type of light source, configured to emit first type of light;

an image sensor, configured to capture an image of a reference surface as a reference image, and to capture a current image; and a control circuit, coupled to the image sensor, configured to perform:

calculating a fixed pattern according to a difference between the reference image and the current image; and calculating a dirtiness level of the image sensor according to the fixed pattern; and generating a notifying message if the dirtiness level is higher than a dirtiness threshold;

wherein the reference surface is provided on a charging station which can charge the robot cleaner.

12. The robot cleaner of claim 11, wherein the reference surface comprises a blank area, or comprises a reference area with a specific color or a fixed pattern.

13. A dirtiness level determining method, applied to a robot cleaner comprising an image sensor, comprising:

(a) capturing a first image at a first time point according to first type of light;

(b) capturing a second image at a second time point after the first time point according to the first type of light;

(c) calculating a first fixed pattern according to a first difference between the first image and the second image;

(d) calculating a first dirtiness level of the image sensor according to the first fixed pattern;

(e) generating a first notifying message if the first dirtiness level is higher than a dirtiness threshold;

wherein the dirtiness level determining method further comprises:

selecting one of the first type of light and second type of light as light applied by the robot cleaner according to which one of the first dirtiness level and the second first dirtiness level is more reliable.

14. A robot cleaner, comprising:

a first type of light source, configured to emit first type of light;

an image sensor, configured to capture a first image at a first time point, and to capture a second image at a second time point after the first time point, according to the first type of light; and a control circuit, coupled to the image sensor, configured to perform:

(a) calculating a first fixed pattern according to a first difference between the first image and the second image;

(b) calculating a first dirtiness level of the image sensor according to the first fixed pattern; and (c) generating a notifying message if the first dirtiness level is higher than a dirtiness threshold;

wherein the robot cleaner further comprises:

a second type of light source, configured to generate second type of light;

wherein the control circuit further calculates a second dirtiness level of the image sensor based on the step (a) and the step (b) according to the second type of light, after calculating the first dirtiness level.

15. A robot cleaner, comprising:

a first type of light source, configured to emit first type of light;

an image sensor, configured to capture a first image at a first time point, and to capture a second image at a second time point after the first time point, according to the first type of light; and a control circuit, coupled to the image sensor, configured to perform:

(a) calculating a first fixed pattern according to a first difference between the first image and the second image;

(b) calculating a first dirtiness level of the image sensor according to the first fixed pattern; and (c) generating a notifying message if the first dirtiness level is higher than a dirtiness threshold;

wherein the robot cleaner further comprises:

a second type of light source, configured to generate second type of light;

wherein the control circuit further selects one of the first type of light and the second type of light as light applied by the robot cleaner according to which one of the first dirtiness level and the second first dirtiness level is more reliable.

16. A robot cleaner, comprising:

a first type of light source, configured to emit first type of light;

an image sensor, configured to capture a first image at a first time point, and to capture a second image at a second time point after the first time point, according to the first type of light; and a control circuit, coupled to the image sensor, configured to perform:

(a) calculating a first fixed pattern according to a first difference between the first image and the second image;

(b) calculating a first dirtiness level of the image sensor according to the first fixed pattern; and (c) generating a notifying message if the first dirtiness level is higher than a dirtiness threshold;

wherein the robot cleaner further comprises:

a second type of light source, configured to generate second type of light;

wherein the control circuit determines a surface type of a surface which the robot cleaner is provided on, and selects one of the first type of light and the second type of light to perform the step (a) and the step (b) according to the surface type.

17. A robot cleaner, comprising:

a first type of light source, configured to emit first type of light;

an image sensor, configured to capture a first image at a first time point, and to capture a second image at a second time point after the first time point, according to the first type of light; and a control circuit, coupled to the image sensor, configured to perform:

(a) calculating a first fixed pattern according to a first difference between the first image and the second image;

(b) calculating a first dirtiness level of the image sensor according to the first fixed pattern; and (c) generating a notifying message if the first dirtiness level is higher than a dirtiness threshold;

wherein the image sensor captures an image of a reference surface as a reference image, and captures a current image, wherein the control circuit is further configured to perform:

calculating a second fixed pattern according to a difference between the reference image and the current image; and calculating a second dirtiness level of the image sensor according to the second fixed pattern; and generating a second notifying message if the second dirtiness level is higher than the dirtiness threshold;

wherein the reference surface is provided on a charging station which can charge the robot cleaner.

18. The robot cleaner of claim 17, wherein the reference surface comprises a blank area, or comprises a reference area with a specific color or a fixed pattern.

* * * * *